US007060221B2

(12) United States Patent
Albinsson

(10) Patent No.: US 7,060,221 B2
(45) Date of Patent: Jun. 13, 2006

(54) HARDENING FIXTURE

(75) Inventor: Göran Albinsson, Lidköping (SE)

(73) Assignee: Kapman AB, Sandviken (SE)

( * ) Notice: Subject to any disclaimer, the term of this patent is extended or adjusted under 35 U.S.C. 154(b) by 393 days.

(21) Appl. No.: 10/433,468

(22) PCT Filed: Dec. 6, 2001

(86) PCT No.: PCT/SE01/02696

§ 371 (c)(1),
(2), (4) Date: Jun. 3, 2003

(87) PCT Pub. No.: WO02/46674

PCT Pub. Date: Jun. 13, 2002

(65) Prior Publication Data

US 2004/0036203 A1 Feb. 26, 2004

(30) Foreign Application Priority Data

Dec. 7, 2000 (SE) ..... 0004521

(51) Int. Cl.
*F27D 5/00* (2006.01)
*C21D 9/24* (2006.01)

(52) U.S. Cl. ..... 266/274; 432/261

(58) Field of Classification Search ..... 266/274; 432/253, 261

See application file for complete search history.

(56) References Cited

U.S. PATENT DOCUMENTS

| | | | | |
|---|---|---|---|---|
| 1,233,193 | A * | 7/1917 | Cook | 266/274 |
| 1,600,266 | A * | 9/1926 | Armstrong | 266/274 |
| 2,039,927 | A * | 5/1936 | Poglein | 432/259 |
| 2,954,222 | A * | 9/1960 | Evans | 266/274 |
| 6,210,500 | B1 * | 4/2001 | Zurfluh | 148/646 |

FOREIGN PATENT DOCUMENTS

| | | |
|---|---|---|
| DE | 31 24 252 | 3/1983 |
| DE | 34 08 944 | 9/1985 |
| DE | 297 21 475 U1 | 4/1998 |
| DE | 196 51 408 | 6/1998 |
| EP | 0 213 333 | 3/1987 |

* cited by examiner

*Primary Examiner*—Scott Kastler
(74) *Attorney, Agent, or Firm*—Buchanan Ingersoll P.C.

(57) ABSTRACT

Hardening fixture for simultaneous hardening of a multitude of sawblades, comprising a bottom plate against which the lower ends of the sawblades are supported, vertical pillars and side plates with lateral openings, where guiding strips and distance elements keep the sawblades parallel close to each other without compressive force, where the structural parts are made from graphite with a surface coating not containing carbon.

11 Claims, 1 Drawing Sheet

HARDENING FIXTURE

BACKGROUND

Sawblades for metal are commonly made with teeth from high-speed steel, or sometimes wholly from high-speed steel, which refers to steel alloys containing tungsten and chromium. To get the desired wear resistance, the saw blades must be hardened at a very high temperature, normally by heating to a temperature around 1200 degrees C. during a few minutes, followed by rapid cooling with gas or liquid, and thereafter annealing during up to 60 minutes at around 550 degrees C.

The hardening temperature of 1200 degrees C. is so high, that any other steel alloy would be deformed even during such a short heating period, and traditionally sawblades for metal have been hardened while suspended vertically from a chain conveyor, and then being heated by radiation or salt bath, followed by cooling by cold gas or oil immersion. Important disadvantages of handling suspended saw blades is the time needed for mounting and dismounting, and the relatively great distance between the hanging blades which gives the hardening oven a low production capacity unless it is made very spacious. Hardening ovens are also known where the sawblades are tightly packed in fixtures as in the patent U.S. Pat. No. 6,147,328, but that makes it difficult to get a sufficiently fast and even cooling.

Another traditional known hardening method involves local heating only of the teeth of the sawblade such as by electric induction, but this method also requires a spacious hardening plant to get the required time at high temperature.

The present invention concerns a fixture which allows rapid uniform heating and cooling of a large number of sawblades within a limited space, and which is constructed in such a way that deformation of the sawblades and fixture at the high temperature is prevented.

DESCRIPTION

Figure 1:
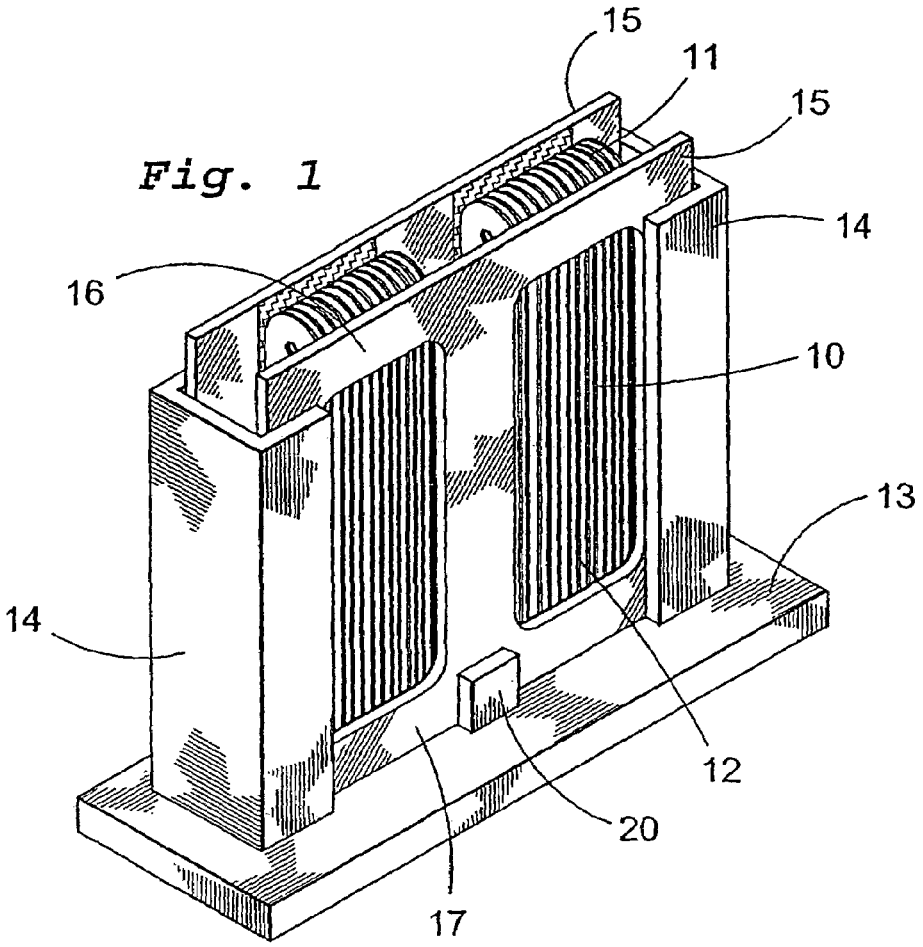
FIG. 1 shows a hardening fixture with sawblades standing therein.
Figure 2:
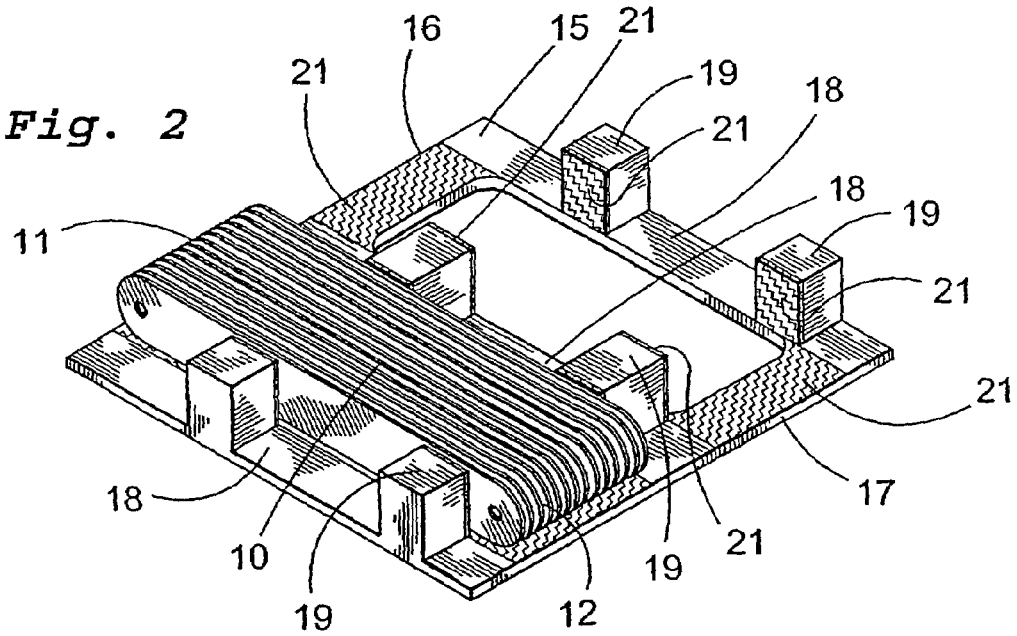
FIG. 2 shows a part of an opened hardening fixture with sawblades.

One purpose of the hardening fixture is that it should confine a large number of sawblades with such reduced mobility that they will not be deformed at the high temperature, but yet with enough mobility to allow uniform cooling thereafter by a gas flow. Another purpose is that the hardening fixture should be made from such a material that will not itself be deformed or affected by repeated heating and cooling, and that will not cause chemical alterations of the sawblades at the points where they contact the hardening fixture. A third purpose is that the hardening fixture should confine the sawblades without contact forces between the blades, because contact forces can make the sawblades stick to each other by diffusion welding.

A hardening fixture according to the invention is made such that it can simultaneously confine and support a large number of sawblades 10, preferably up to 300 pieces depending on their thickness. They are standing vertically supported on their lower ends 12 and have upper ends 11 that are free but oriented by the hardening fixture. The flat lateral surfaces of the sawblades are close to each other without any compressive force. The number of saw blades in the hardening fixture may vary depending on the thickness of the sawblades. Since the sawblades are standing vertically, the same fixture can be used for sawblades with different lengths within some limits, and for sawblades with different shapes of their ends, also without holes.

The hardening fixture comprises a bottom plate 13 rigidly connected to two vertical pillars 14 and two separate side plates 15. Each vertical pillar can be made with a uniform U-shaped section, or assembled from flat components. Each side plate is provided with an upper guiding strip 16, a lower guiding strip 17 and at least two vertical strips 18, and has lateral openings between the strips. The vertical strips are provided with distance elements 19. The bottom plate can be provided with guiding elements 20. The side plates 15 define a sawblade-receiving first recess, and the pillars define an upwardly open second recess for receiving the side plates.

When sawblades are to be confined in the hardening fixture, the sawblades are placed parallel to each other on a first side plate 15 until they fill the space between the distance elements 19 without contact forces between the sawblades. The second side plate is then placed on the first side plate, and both side plates with the sawblades between them are inserted between the vertical pillars 14 until the lower ends 12 of the sawblades touch the bottom plate 13. Alternatively, the side plates can at first be inserted between the vertical pillars, and bundles of sawblades can later be inserted between the distance elements, and if this method is used, the side plates can be connected to each other by the distance elements. If the side plates 15 have more than two vertical strips 18 there are spaces for more than one bundle of sawblades, but all spaces need not be filled. The sawblades are thus arranged side-by-side in a direction parallel to mutually facing side surfaces of the side plates.

To start the heating to the hardening temperature, the hardening fixture with the sawblades standing in it is carried by a conveyor into a heating zone between two radiating heater plates which may be electrically heated to a predetermined temperature. The heater plates are located so close to the hardening fixture that the sawblades and the hardening fixture are rapidly heated through the lateral openings. The side plates 15 keep the sawblades parallel at a desired uniform distance from the heater plates. The ends 11,12 of the sawblades are hidden by the guiding strips 16,17 and will not be heated as much, which will give them a desirable greater toughness and lower hardness.

By means of the conveyor the hardening fixture and the sawblades are thereafter carried to a cooling zone where gas of a predetermined temperature is blown against the edges of the sawblades through a multitude of nozzles located very close to the lateral openings. Since the sawblades are not pressed together, is and by gradual motion of the hardening fixture relative to the nozzles, the sawblades will vibrate relative to each other and allow the gas to penetrate between them to cause an even cooling.

When the sawblades 10 have been cooled and after that annealed long enough in a second heating zone, they may be removed from the hardening fixture if it is taken apart or turned upside down. If it is desired to use the same heating zone and cooling zone for sawblades of different width without adjusting the position of the heating plates or coolant nozzles, the hardening fixture may be made to allow placing of the wider sawblades in another angle than perpendicular to the side plates 15, which may also be simplified if the sides of the distance elements 19 facing the sawblades each one is formed with that angle.

In order to avoid deformation at the high temperature, the hardening fixture is made from graphite, preferably reinforced with carbon fibres. Direct contact of graphite or carbon fibres with steel at those high temperatures would cause carbon diffusion into the steel and a corresponding increase of brittleness, which is not allowed. The surfaces of the hardening fixture, especially the side plates 15, the distance elements 19 and the bottom plate 13, which might get in contact with the steel of the sawblades must therefore be covered with a thin layer of a wear resistant material 21 not containing carbon or other substances which might diffuse into the steel to deteriorate its properties, but still stable at high temperatures. Examples of such materials are ceramics as boron nitride, silicon nitride, silicon dioxide, zirconium oxide are aluminium oxide. Certain high temperature resistant metals such as molybdenum or chromium alloys may be used.

Within the concept of the invention, the design of the hardening fixture may to some extent be varied and adapted to special shapes of the sawblades or the conveyor used for carrying the hardening fixture through the hardening plant. The number of vertical strips may be varied, and if desired the bottom plate may be made to accommodate several parallel pairs of side plates. The vertical pillars 14 might also be integrated with the side plates 15 or the distance elements 19.

The invention claimed is:

1. Hardening fixture for supporting a plurality of sawblades during simultaneous hardening thereof, the fixture comprising:

a pair of side plates for defining therebetween a first space for simultaneously supporting a plurality of sawblades in side-by-side relationship;

a pillar structure defining a second space for receiving the side plates, with side-by-side sawblades in the first space being in vertically standing orientation;

a bottom plate arranged beneath the second space for simultaneously supporting lower ends of respective vertically standing sawblades; and distance elements arranged for holding vertically standing sawblades adjacent one another in the first space without compressive force;

wherein the pillar structure, the side plates, the bottom plate and the distance elements comprise graphite; and further wherein surfaces of the fixture arranged for making sawblade contact are coated with a carbon-free material.

2. Hardening fixture according to claim 1 wherein each distance element is attached to a side plate and situated within the first space.

3. Hardening structure according to claim 1 wherein the side plates are removable from the second space.

4. Hardening fixture according to claim 1 wherein the graphite is reinforced with carbon fibers.

5. Hardening fixture according to claim 1, wherein the surface coating material comprises ceramic nitrides or oxides or combinations thereof.

6. Hardening fixture according to claim 1 wherein the surface coating material comprises a high temperature resistant metal.

7. Hardening fixture according to claim 6 wherein the high temperature resistant material comprises molybdenum.

8. Hardening fixture according to claim 6, wherein the high temperature resistant material comprises a chromium alloy.

9. Hardening fixture for supporting a plurality of sawblades during simultaneous hardening thereof, the fixture comprising:

a pair of side plates including mutually facing side surfaces defining therebetween a first space for simultaneously supporting a plurality of sawblades arranged side-by-side in a direction parallel to the mutually facing side surfaces;

a pillar structure defining an upwardly open second space for removably receiving the side plates, with side-by-side sawblades in the first space being in vertically standing orientation;

a bottom plate attached to the pillar structure and disposed beneath the second space for simultaneously supporting lower ends of respective vertically standing sawblades; and distance elements each attached to a side plate and arranged for holding a plurality of vertically standing sawblades adjacent one another in the first space without compressive force.

10. Hardening fixture according to claim 9, wherein surfaces of the fixture arranged for making sawblade contact are coated with a carbon-free material.

11. Hardening fixture according to claim 9, wherein the pillar structure, the side plates, the bottom plate and the distance elements comprise graphite.

* * * * *